US006074244A

United States Patent [19]

Crum et al.

[11] Patent Number: 6,074,244

[45] **Date of Patent: *Jun. 13, 2000**

[54] STRINGER OF DECORATIVE LIGHTS

[76] Inventors: Frank Andrew Crum, 7322-A Hwy. 70 South, Nashville, Tenn. 37221; Robert Kenneth Schunk, 804 Davis Dr., Brentwood, Tenn. 37027

[ * ] Notice: This patent issued on a continued prosecution application filed under 37 CFR 1.53(d), and is subject to the twenty year patent term provisions of 35 U.S.C. 154(a)(2).

[21] Appl. No.: 08/900,898

[22] Filed: Jul. 25, 1997

[51] Int. Cl.[7] ..... H01R 11/00

[52] U.S. Cl. ..... 439/505; 439/139

[58] Field of Search ..... 439/505, 139, 439/672

[56] References Cited

U.S. PATENT DOCUMENTS

| | | | |
|---|---|---|---|
| 2,277,532 | 3/1942 | Smith, Jr. . | |
| 2,533,222 | 12/1950 | Cohen | 362/249 |
| 3,214,579 | 10/1965 | Pacini | 362/143 |
| 3,335,389 | 8/1967 | Reichrdt | 439/505 |
| 3,387,255 | 6/1968 | Earleywine | 439/672 |
| 3,458,849 | 7/1969 | Marks et al. | 439/505 |
| 3,609,643 | 9/1971 | Connan | 439/419 |
| 4,631,650 | 12/1986 | Ahroni | 362/249 |
| 4,777,573 | 10/1988 | Liao | 362/249 |
| 4,779,177 | 10/1988 | Ahroni | 362/236 |
| 4,870,547 | 9/1989 | Crucefix | 362/123 |
| 4,984,999 | 1/1991 | Leake | 439/425 |
| 5,495,147 | 2/1996 | Lanzisera | 315/185 SS |
| 5,593,324 | 1/1997 | Ito | 439/672 |
| 5,639,246 | 6/1997 | Holmes | 439/505 |

FOREIGN PATENT DOCUMENTS 6-076902 3/1994 Japan .

OTHER PUBLICATIONS

Industrial Devices, Inc. *Design Engineers Databook: Indicator Lights* (FC492), Published 1992, Hackensack, NJ 07601 Section 1 pp. 1–15, Section 2 pp. 5–6, Section 6 pp. 1–5 Phone Number 201–489–8989.

NFPA Report: National Fire Protection Association, Quincy, MA 02269–9101. *Christmas Tree Fires in US Homes*—Report updated Mar., 1997. Fax Number 617–984–7478.

*Primary Examiner*—Steven L. Stephan
*Assistant Examiner*—T C Patel
*Attorney, Agent, or Firm*—David B. Pieper; Waddey & Patterson

[57] ABSTRACT

A stringer of decorative lights comprising of a parallel wired primary and secondary light stringer. Each decorative light stringer includes a plurality of neon lamp assemblies having a step-down transformer. Each lamp socket typically includes a rotary safety disc. The secondary light stringer has a lamp socket compatible male plug. This lamp socket compatible male plug is used to connect this secondary light stringer to any lamp socket of the primary light stringer. Each lamp typically includes an insulated lamp base for receiving lamp, and a plurality of electrical contacts depending from the lamp base and connected to the lamp. A quick release mounting method for a bayonet lamp is also disclosed.

7 Claims, 8 Drawing Sheets

STRINGER OF DECORATIVE LIGHTS

BACKGROUND OF THE INVENTION

1. Field of Invention

This invention relates to a stringer of decorative lights.

2. Background—Description and Evolution of Prior Art

Prior art has seen the development of a wide variety of approaches to forming a stringer of decorative lights, as for showrooms, Christmas trees, and the like.

Originally, stringers of decorative lights utilized line voltage designed incandescent lamps with a screw shell base. The stringers of decorative lights utilized a plurality of matching screw shell sockets connected in a parallel wired circuit. If a lamp were to be removed, or failed during use, the remaining lamps would continue to operate properly. While this wiring circuitry provided a stringer of lights that were relatively easy to maintain, the incandescent lamps that were utilized consumed large amounts of power, and, by design, produced heat. One of the problems associated with the use of these stringers of lights, if applied to a cut live tree, was the rapid drying out of branches and needles. Additionally, if a lamp were to be removed from these stringers during operation, the user could accidentally come in contact with the line voltage due to the exposed electrical contacts of the lamp socket.

Subsequent improvements incorporated the use of miniature incandescent lamps connected in a series wired circuit. (U.S. Pat. No. 3,609,643 to Conan (1971).) While these miniature incandescent lamps reduce the amount of over all heat produced, the series wired circuitry substantially increased the amount of maintenance. This is because in a series wired stringer of lights, when one lamp is removed, or fails to operate, the entire stringer will not operate. This makes it very difficult to locate a faulty lamp or lamps in this type of light stringer.

Further improvements utilize a series-parallel wired circuit to operate the miniature incandescent lamps. (U.S. Pat. Nos. 4,631,650 (1986) and 4,799,177 (1988) both to Ahroni.) While this type of circuitry reduces the number of lamps affected by the removal of a lamp, or failure of a lamp, it does not eliminate this problem entirely.

The difficulty in locating a defective lamp is not the only problem common to both the series and the series-parallel wired stringers of decorative lights. The variety of circuitry types and stringer lengths that are available has led to the use of miniature incandescent lamps that have many different operating voltages. Many of these miniature incandescent lamps utilize the same style and size of lamp base. This can leave the user with incompatible, or non-standardized, lamps and light stringers. Due to the similarity of style, these can be misused and create a potentially dangerous safety hazard.

Additionally, should a series or series-parallel wired stringer of lights experience a short circuit creating an over-voltage, the incandescent lamps remaining within the short circuit absorb this over-voltage condition. This causes the filament of the incandescent lamps to overheat or in some instances, to superheat. This creates the potential for the glass envelope of the miniature incandescent lamp to explode. The temperature and fire ratings of the materials used for the lamp bases, lamp sockets, electrical wire insulation, etc. can be exceeded by such a short circuit condition. The amount of damage to these items, as well as any surrounding materials, is dependent upon the location of the short circuit in relation to its power source, as well as, the length of time these items remain in the short circuit condition. Even the double fuse protection that is found today in the male cord caps of the newer versions of series and series-parallel wired incandescent light stringers, can not fully protect these types of light stringers from all potential short circuits.

A March 1997 report from the National Fire Protection Association (NFPA) states that "the leading cause of Christmas tree fires and property damage was short circuits and ground faults, with roughly 1 in 4 fires". In the U.S. alone, an annual average of 100 fires, 9 deaths, 20 injuries and $5.1 million in property damage can be directly attributed to stringers of lights that experience short circuits or ground faults, states the same report.

More recent developments have seen the introduction of light emitting diodes (LED's) to form a stringer of lights. (U.S. Pat. No. 4,984,999 to Leake (1991) and U.S. Pat. No. 5,495,147 to Lanzisera (1994).) A low voltage transformer is utilized to power a parallel wired circuitry to operate the LED's. While this type of light stringer provides a safer, low voltage, energy efficient stringer of lights, in practical applications such as fully decorating a tree, its limited in its overall length and to the number of LED's by the voltage-amperage size, or output, of the low voltage transformer. Additionally, these low voltage transformers, when loaded, produce a substantial amount of heat.

The series and series-parallel wired light stringers are limited in the way additional light stringers are connected to the initial set. This limits the number of lighting design options available to the user when utilizing these types of light stringers.

From the foregoing it can be seen that prior art fails to provide a stringer of lights that is energy efficient, low heat producing, and easy to maintain. Such a stringer of lights is needed. A stringer with improved safety and short circuit protection is needed. It should be capable of using different sources of illumination, while providing a new flexibility in decorative lighting design.

SUMMARY OF THE INVENTION

The invention relates generally to lighting and more particularly to light strings. One embodiment of the invention is for a stringer of lights. The light string comprises a first power cord including a plug; a plurality of lamp sockets assemblies electrically connected in parallel to the first power cord; and a plurality of lamp assemblies removably inserted into, and electrically connected to the lamp sockets, respectively, each lamp assembly including a voltage reducing circuit.

Each lamp assembly further includes an insulated lamp base adapted to be received in the lamp socket assemblies; a lamp disposed within the lamp base; and a plurality of lamp electrical contacts extending below the lamp base and electrically connected to the lamp.

Each lamp socket assembly includes a lamp socket having a top for receiving the lamp bases, and a bottom connected to the first power cord; a plurality of lamp socket electrical contacts proximate the bottom electrically connected to the power cord; and a safety disc in the lamp socket interposed between the top of the lamp socket and the lamp socket electrical contacts, the safety disc including safety means for preventing inadvertent contact with the lamp socket electrical contacts while allowing intentional contact between the lamp electrical contacts and the lamp socket electrical contacts.

The safety means includes a pair of contact openings through which the lamp electrical contacts may pass, the contact openings aligned with the lamp socket electrical contacts when the lamp base is mounted in the lamp socket and otherwise off alignment with the lamp socket electrical contacts.

The stringer of lights also typically uses a bayonet style lamp assembly in which the lamp base includes diametrically opposed alignment pins; the lamp socket includes an interior surface having diametrically opposed vertical grooves for receiving the alignment pins, a lower pair of horizontal grooves in the upper interior surface proximate the lamp socket electrical contacts, a pair of horizontal grooves in the interior surface proximate the top of the lamp socket, each upper horizontal groove opening on one of the vertical alignment grooves; and the safety disc being rotatably mounted into the lower pair of horizontal grooves, whereby the bayonet lamp assembly may be inserted into the lamp socket, the lamp electrical contacts passing through the safety disc contact openings, and rotated into alignment in the upper horizontal grooves such that the lamp electrical contacts and lamp socket electrical contacts electrically connect.

In one preferred embodiment the stringer includes a second power cord having a plug, the plug adapted to be removably inserted into one of the lamp sockets connected to the first power cord; a plurality of lamp socket assemblies electrically connected in parallel to the second power cord; and a plurality of lamp assemblies removably inserted into, and electrically connected to, respective lamp sockets, each lamp assembly including a voltage reducing circuit.

In one preferred embodiment the lamp is a neon lamp and the voltage reducing circuit includes a resistor connected to the neon lamp. The lamp may also be a light emitting diode, where the voltage reducing circuit includes a resistor or resistors and a bridge rectifier connected to the light emitting diode. Or, the lamp may be an incandescent lamp, where the voltage reducing circuit includes a resistor, or a diode and a resistor connected to the incandescent lamp.

Another embodiment of the invention includes a lamp assembly including a lamp; an insulated lamp base for receiving the lamp; and a plurality of electrical contacts depending from the base and connected to the lamp.

Another embodiment of the invention includes a string of decorative lights comprising a power cord including a plug; a plurality of lamp socket assemblies electrically connected to the power cord, each lamp socket assembly including a lamp socket having an interior surface, a top, a vertical alignment groove in the interior surface depending from the top, and a horizontal groove in the interior surface opening on the vertical alignment groove; and a plurality of lamp assemblies each having a lamp base including an alignment pin, the lamp base removably inserted onto one of the lamp sockets, the alignment pin engaging the horizontal groove to secure the lamp base in the lamp socket.

One embodiment includes an improved lamp socket having a top, a bottom, and lamp socket electrical contacts proximate the bottom, the lamp socket adapted to receive a lamp assembly having lamp electrical contacts. The improvement includes a safety disc within the lamp socket and positioned between the top and the lamp socket electrical contacts. The safety disc has safety means to prevent inadvertent contact with the lamp socket electrical contacts while allowing intentional electrical contact between the lamp electrical contacts and the lamp socket electrical contacts.

OBJECTS AND ADVANTAGES

Accordingly several objects and advantages of the invention includes, a stringer of decorative lights that utilizes the parallel wired circuitry to operate energy efficient, low heat producing lamps. By utilizing the parallel wired circuitry, the removal of a lamp will not affect the remaining lamps of the primary and secondary light stringer, or any additional interconnected light stringers. This provides the user with an easier to maintain stringer of decorative lights.

The parallel wired circuitry allows fuse protection to work more efficiently in the event of a short circuit, providing the user with improved short circuit protection.

Another object of the invention is to protect the user from accidental contact with energized electrical lamp socket contacts. This rotary safety disc covers these electrical contacts when a lamp assembly or, lamp socket compatible, male plug is removed. This provides the user a stringer of decorative lights with an additional safety feature.

The lamp bases of the lamp assemblies contain and enclose the necessary electronic components, or voltage reducing circuit means, which now make it possible to operate a variety of low voltage lamps, as well as line-voltage lamps, at standard residential power of 120 volts AC. or greater. By correctly sizing the proper electronic components, many different sources of illumination with various operating design voltages can be utilized in these lamp assemblies.

An object of the invention is to provide improved bayonet style lamp socket to retain the lamp assemblies. This improved bayonet lamp socket provides the user with a quick and easy method of installing and removing lamp assemblies and any secondary light stringers using a bayonet plug.

Further objects and advantages of our invention will become apparent from a consideration of the drawings and ensuing description.

BRIEF DESCRIPTION OF THE DRAWINGS

In the drawings, closely related figures have the same number but different alphabetic suffixes.

DESCRIPTION OF THE PREFERRED EMBODIMENTS

Figure 1:
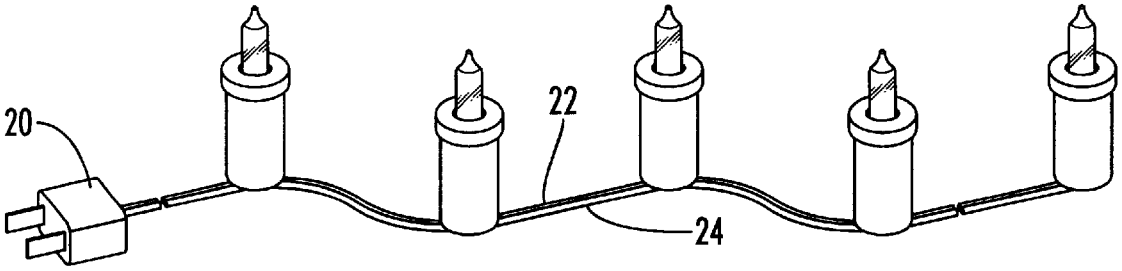
FIG. 1 shows an isometric view of a primary light stringer.

Applicant's invention will be best understood when considered in light of the following description of the preferred embodiment of the invention, as illustrated in the attached drawings wherein like reference numerals and characters refer to like parts.

Description of the Primary Light Stringer

Figure 2:
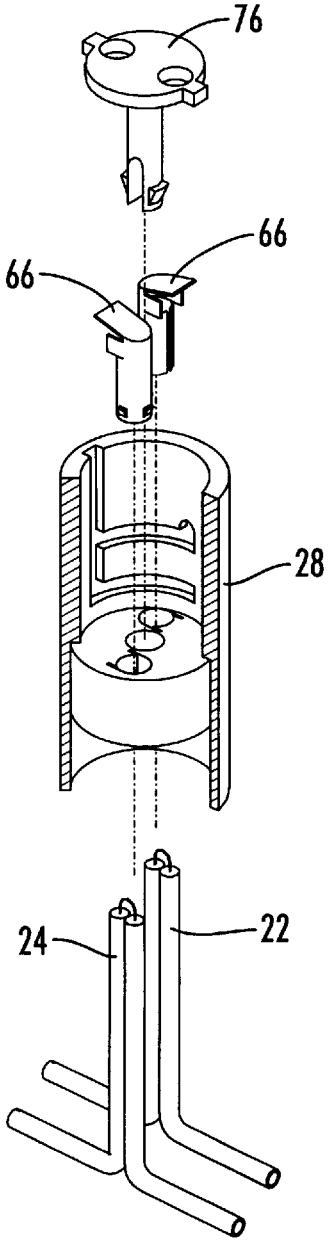
FIG. 2 shows an enlarged isometric exploded view of a lamp socket assembly.

FIG. 1 shows an isometric view of a primary light stringer. The primary light stringer has a standard male plug 20. Attached to the standard male plug 20 is an insulated electrical wire 22. The insulated electrical wire 22 is of a predetermined length. Wire 22 at predetermined locations along its length, has predetermined amounts of insulation removed. Wire 22 is doubled precisely at the center point of insulation removal. This doubling of wire 22 continues along its length at the predetermined locations. Attached to plug 20 is an insulated electrical wire 24. The insulated electrical wire 24 is of a predetermined length. Wire 24 at predetermined locations along its length, has predetermined amounts of insulation removed. Wire 24 is doubled precisely at the center point of insulation removal. This doubling of wire 24 continues along its length at the predetermined locations. Wire 22 and wire 24 are parallel in relation to each other. Refer to FIG. 2.

Figure 3A:
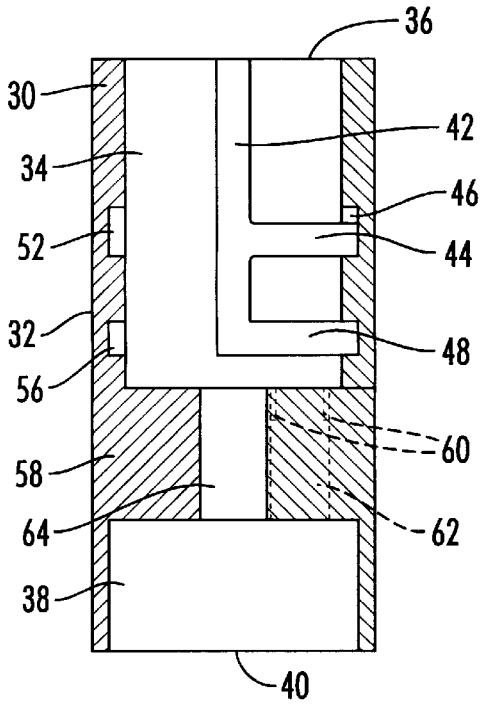
FIGS. 3*a* to 3*d* show various sections and enlarged views of the lamp socket.

FIG. 2 shows an enlarged isometric exploded view of a lamp socket assembly 26. The lamp socket assembly 26 has a lamp socket 28. Refer to FIGS. 3*a,* 3*b,* 3*c,* and 3*d.*

FIGS. 3*a,* 3*b,* 3*c,* and 3*d,* show various sections and enlarged views of the lamp socket 28. Lamp socket 28 is preferably a modified version of the bayonet, double contact design. However, any lamp socket design may be used which can electrically energize a neon lamp, a light emitting diode, an incandescent lamp or the like. Lamp socket 28 is preferably molded of a fire-resistant synthetic resin of a suitable type, such as thermosetting phenol resin, phenol formaldehyde, polyvinyl chloride resin, polypropylene, or the like.

Lamp socket 28 is molded generally, in a cylindrical shape. Lamp socket 28 has a side wall 30, which is of a predetermined thickness. The side wall 30 has a non-perforated exterior side wall surface 32. Side wall 30 has an upper interior side wall surface 34 and a top edge 36. Side wall 30 has a lower interior side wall surface 38 and a bottom edge 40.

Molded into the top edge 36 and into the upper interior side wall surface 34, is a vertical groove 42. The vertical groove 42 is in a predetermined location on interior side wall surface 34. At a predetermined distance down vertical groove 42 is a horizontal groove 44, which intersects the right side of this vertical groove 42. Horizontal groove 44 extends a predetermined distance around interior side wall surface 34. The upper right end of the horizontal groove 44 is intersected by a 180-degree groove 46. The 180-degree groove 46 extends up interior side wall surface 34 to a predetermined distance.

At the bottom end of vertical groove 42 is a horizontal groove 48, which intersects the right side of this vertical groove 42. Horizontal groove 48 extends a predetermined distance around interior side wall surface 34. Horizontal grooves 44 and 48, vertical groove 42 and 180-degree groove 46 are of a predetermined size, shape, depth, width, and length.

Figure 3B:
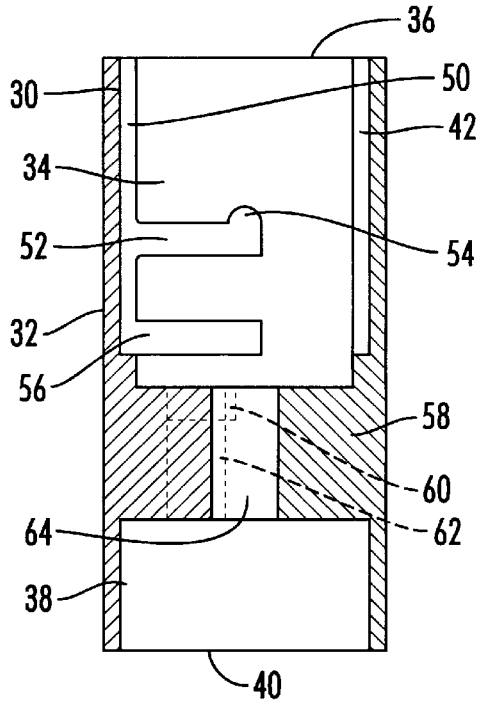
Figure 3C:
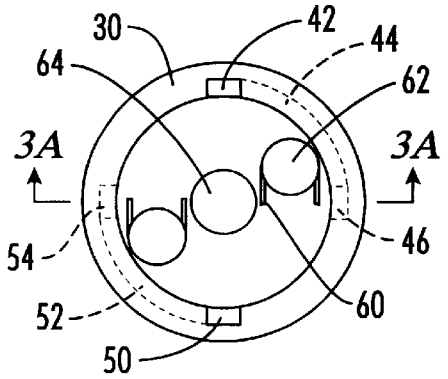
Figure 3D:
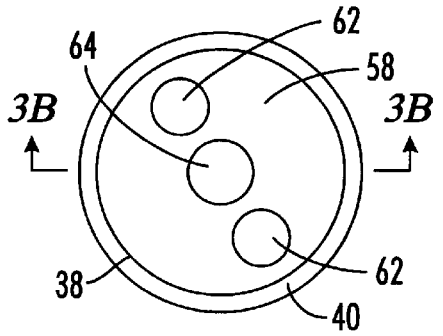

Transposed 180-degrees apart, as viewed in FIG. 3*b,* is an identically matching set of grooves. Molded into top edge 36 and into upper interior side wall surface 34 is a vertical groove 50. The vertical groove 50 is in a predetermined location on interior side wall surface 34. At a predetermined distance down vertical groove 50 is a horizontal groove 52, which intersects the right side of this vertical groove 50. Horizontal groove 52 extends a predetermined distance around interior side wall surface 34. The upper right end of the horizontal groove 52 is intersected by a 180-degree groove 54. The 180-degree groove 54 extends up interior side wall surface 34 to a predetermined distance.

At the bottom end of vertical groove 50 is a horizontal groove 56, which intersects the right side of this vertical groove 50. Horizontal groove 56 extends a predetermined distance around interior side wall surface 34. Horizontal grooves 52 and 56, vertical groove 50 and 180-degree groove 54 are of a predetermined size, shape, depth, width, and length.

Located on the inside of lamp socket 28 and at a predetermined distance down from top edge 36 is a flat base 58. The top and bottom surfaces of the flat base 58 are also flat. Flat base 58 is of a predetermined thickness.

Recessed into the top surface of base 58 is a contact retaining channel 60. A contact retaining channel 60 is located on either side of the longitudinal center of base 58 and in predetermined locations. The contact retaining channels 60 are equidistantly spaced apart in relation to the longitudinal center of base 58. Contact retaining channels 60 are generally U-shaped vertical slots that are recessed into the top surface of base 58 and in predetermined locations. Contact retaining channels 60 are of a predetermined length, width, and depth. Contact retaining channels 60 penetrate into the top surface base 58 to a predetermined depth. Located in the bottom center section of each contact retaining channel 60 is a wireway opening 62. The wireway opening 62 is longitudinally centered through the middle of each contact retaining channel 60. Wireway opening 62 is of a predetermined diameter and depth. Each wireway opening 62 penetrates through the top surface of each contact retaining channel 60 and exits through to the bottom surface of base 58.

Figure 4:
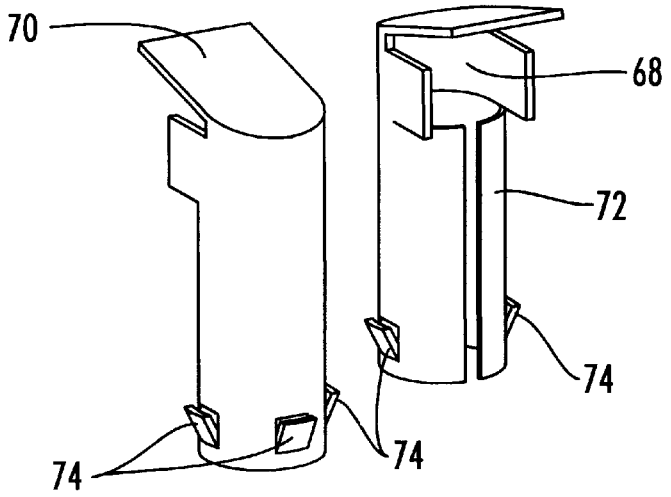
FIG. 4 shows various enlarged isometric views of a lamp socket electrical contacts.

Recessed into the center top surface of base 58 is a shaft opening 64. Shaft opening 64 is centered in relation to the longitudinal center of base 58. The shaft opening 64 is of a predetermined diameter and depth. Shaft opening 64 penetrates the center top surface of base 58 and exits through to the bottom surface of base 58. Lamp socket 28 has an electrical contact 66. Refer to FIG. 4.

FIG. 4 shows various enlarged isometric views of the electrical contact 66. Contact 66 is preferably made of a spring metal, wire crimp connecting, self-locking design. However, any electrical contact design may be utilized that provides a suitable method of retaining an electrical wire and providing a point of mechanical contact for a lamp.

Contact 66 has a U-shaped vertical plate 68, which is of a predetermined size, shape, height, length, width, and thickness. Located on the top surface and at the back section of the U-shaped vertical plate 68 is a horizontal plate 70. The horizontal plate 70 is of a predetermined width, length, and thickness. Horizontal plate 70 is angled up from the top surface and from the ends of U-shaped vertical plate 68 to a predetermined distance. Located at the back center bottom section of U-shaped vertical plate 68 is a wire crimp connector 72. The wire crimp connector 72 is longitudinally centered in relation to the midpoint of U-shaped vertical plate 68. Crimp connector 72 is generally, hollow and cylindrical in shape. Crimp connector 72 is of a predetermined diameter, length, and thickness. Crimp connector 72 extends vertically below U-shaped vertical plate 68 to a predetermined distance.

Figure 5:
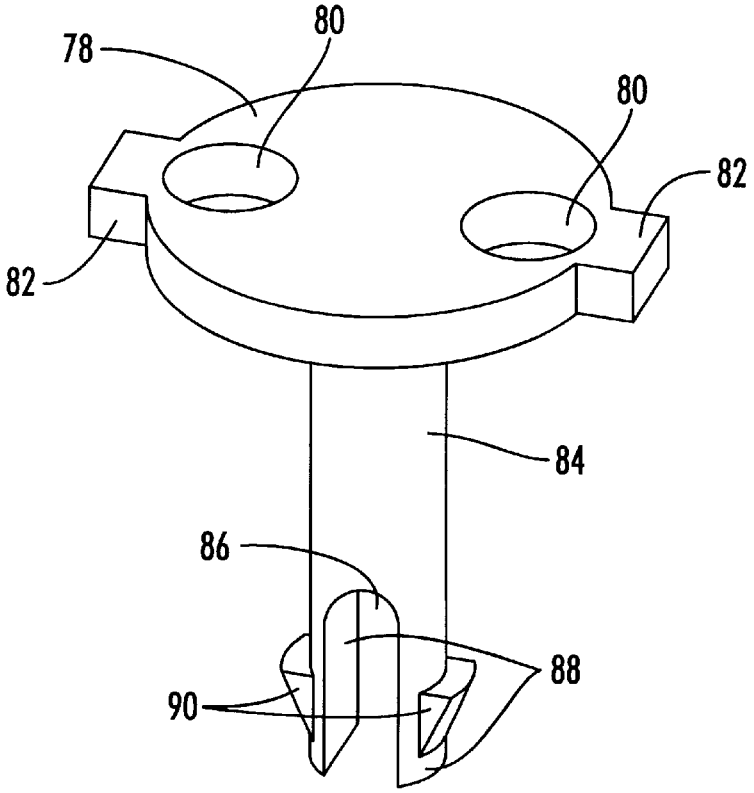
FIG. 5 shows an enlarged isometric view of a rotary safety disc.

Located at a predetermined distance from the bottom end of crimp connector 72 is a plurality of expanding metal, locking fingers 74. The plurality of expanding metal, locking fingers 74 are generally inverted U-shaped slots that are cut into the lower vertical sides of crimp connector 72. The remaining material left within the U-shaped slots is pre-bent outward to a predetermined angle. Expanding metal, locking fingers 74 are of a predetermined size, shape, length, width, angle, and thickness. Lamp socket 28 has a rotary safety disc 76. Refer to FIG. 5.

FIG. 5 shows an enlarged isometric view of the rotary safety disc 76. Safety disc 76 is preferably molded of the same fire-resistant synthetic resin as the above mentioned lamp socket 28. Safety disc 76 has a flat rounded top plate 78.

Located in the top surface and on either side of the longitudinal center of the top plate 78 is a contact opening 80. The contact openings 80 are equidistantly spaced within the top surface of plate 78. Contact openings 80 are of a predetermined diameter. Contact openings 80 penetrate into the top surface of plate 78 and exit through to the bottom surface of plate 78.

Located on the same latitudinal axis with the centers of each contact opening 80 and, on either end of plate 78 is a side-alignment tab 82. Located 180-degrees from side-alignment tab 82 on the opposite outer edge of plate 78 is an identical side-alignment tab 82. Side-alignment tabs 82 are of a predetermined size, shape, width, and length. Side-alignment tabs 82 are of the same thickness as plate 78. The top and bottom surfaces of side-alignment tabs 82 are parallel in relation to the top and bottom surface of plate 78. The outer ends of the side-alignment tabs 82 are curved, to the same curvature as, the upper interior side wall surface 34 of lamp socket 28.

Located on the bottom center surface of plate 78 is a shaft 84. The shaft 84 is longitudinally centered in relation to the bottom midpoint of plate 78. Shaft 84 is perpendicular in relation to the bottom center of plate 78. Shaft 84 is of a predetermined length and diameter.

At a predetermined distance down shaft 84 is a slot 86. The slot 86 equally penetrates through the curved sides of shaft 84 and, extends to the end of shaft 84. Slot 86 is centered through the longitudinal center of shaft 84. Slot 86 is located 90-degrees in relation to side-alignment tabs 82. Slot 86 is of a predetermined size, shape, and length. Slot 86 splits shaft 84 into, two semi-circular shafts 88 of equal size, shape, and length.

Figure 6:
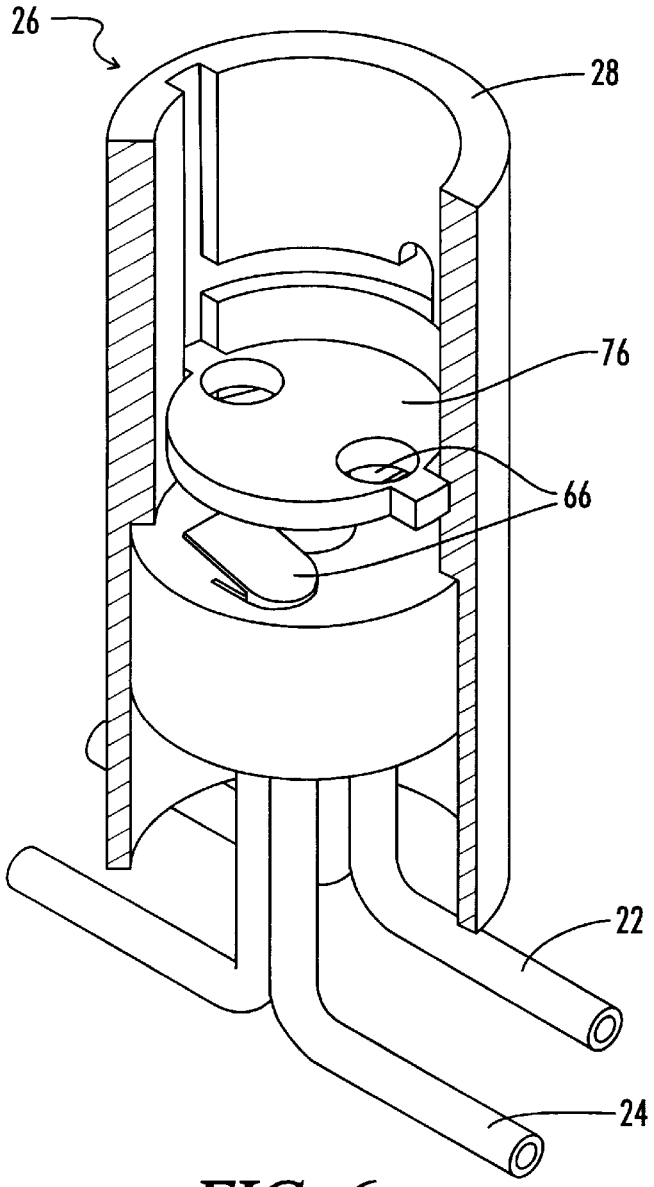
FIG. 6 shows an enlarged isometric cut away view of the completed lamp socket assembly.
Figure 7:
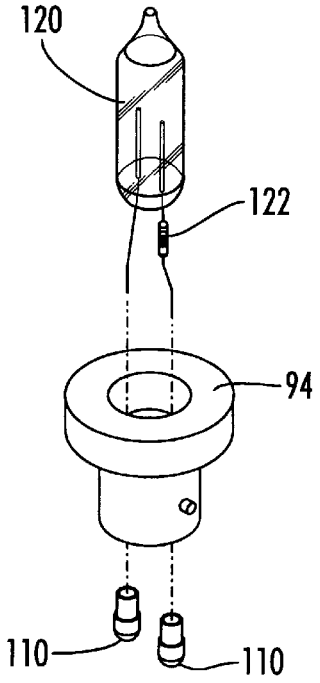
FIG. 7 shows an enlarged isometric exploded view of the neon lamp assembly.

Located on the exterior curved sides and at a predetermined distance from the ends of the two semi-circular shafts 88 are two, right angled, extended, self-locking fingers 90. The right-angled, extended, self-locking fingers 90 are laterally aligned to the center of the exterior curved sides of semi-circular shafts 88. Self-locking fingers 90 are perpendicular in relation to slot 86. Self-locking fingers 90 are of a predetermined size, shape, length, width, and thickness. Refer to FIG. 6. FIG. 6 shows an enlarged cut away view of the completed lamp socket assembly 26. Refer to FIG. 7.

The Description of the Neon Lamp Assembly 92

Figure 8:
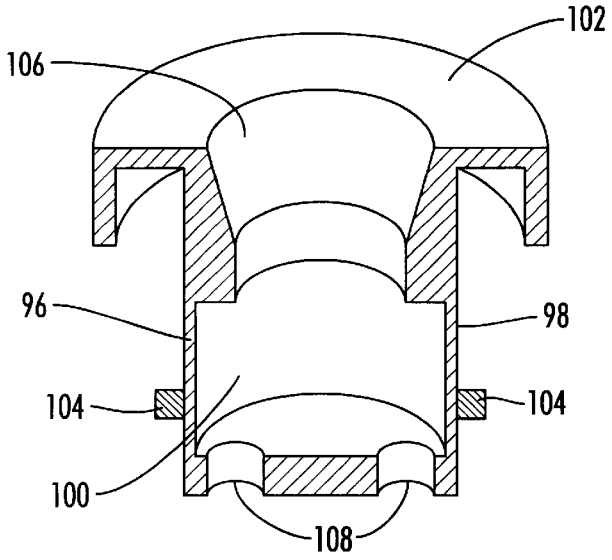
FIG. 8 shows an enlarged isometric cross sectional view of the lamp base.

FIG. 7 shows an enlarged isometric exploded view of a neon lamp assembly 92. The neon lamp assembly 92 has a lamp base 94. Refer to FIG. 8.

FIG. 8 shows an enlarged isometric cross sectional view of the lamp base 94. Base 94 is preferably a modified version of the bayonet, double contact design. Base 94 is preferably molded of the same fire-resistant synthetic resin as the above mentioned lamp socket 28.

Base 94 is molded generally, in a cylindrical shape. Base 94 has a side wall 96, which is of a predetermined thickness. The side wall 96 has an interior side wall surface 100, an exterior side wall surface 98, and a top edge 102. The inside bottom surface as well as the outside bottom surface of base 94 is flat. Base 94 has a side-alignment pin 104. The side-alignment pin 104 is at a predetermined location on the exterior side wall surface 98.

Located 180-degrees on the opposite side of exterior side wall surface 98 is an identical side-alignment pin 104. Side-alignment pins 104 are molded into exterior side wall surface 98. Side-alignment pins 104 are located a predetermined distance above the outside bottom surface of base 94. Side-alignment pins 104 are perpendicular in relation to the exterior side wall surface 98. Side-alignment pins 104 are of a predetermined size, shape, length, and thickness. The outer ends of side-alignment pins 104 are curved to the same curvature as the inside curvature of lamp socket 28.

Located within the interior side wall surface 100 and at a predetermined distance down from the top edge 102 is a funnel shaped 360-degree tapered ledge 106. The funnel shaped 360-degree tapered ledge 106 is of a predetermined size, shape, angle, length, width, diameter and thickness.

Figure 9:
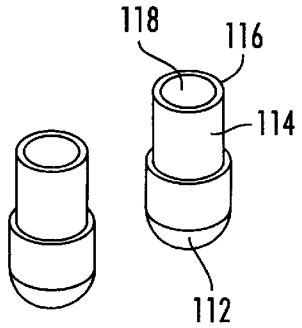
FIG. 9 shows various enlarged isometric views of the (lamp base) electrical contacts.

Located in the bottom surface of base 94 are two contact openings 108. A contact opening 108 is located on either side of the longitudinal center of the bottom surface of base 94. Contact openings 108 are equidistantly spaced within the outside bottom surface of base 94. Contact openings 108 are of a predetermined diameter and depth. Contact openings 108 penetrate into the outside bottom surface of base 94 and exit through to the inside bottom surface of base 94. Base 94 has an electrical contact 110. Refer to FIG. 9.

FIG. 9 shows various enlarged isometric views of the electrical contact 110. Electrical contact 110 is preferably made of a hollow, pan head, metal pin design. However, any electrical contact design may be utilized that provides a suitable method of retaining an electrical wire.

Electrical contact 110 has a pan head 112. The pan head 112 has a semi-circular bottom surface and a flat, top surface. Pan head 112 is of a predetermined size, shape, curvature, length, and diameter. Located in the center of the flat, top surface of pan head 112 is a shaft 114. The shaft 114 is perpendicular in relation to the flat, top surface of pan head 112. Shaft 114 is centered to the longitudinal center of pan head 112. Shaft 114 is of a predetermined diameter, length, and thickness. Shaft 114 has a top edge 116.

Figure 10A:
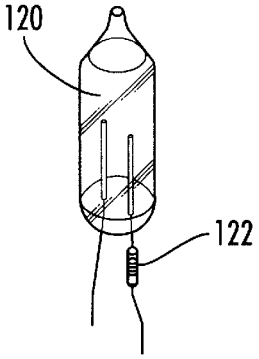
FIG. 10*a* shows an enlarged isometric view of the neon lamp and resistor.

Located within the longitudinal center of each pan head 112 and shaft 114 is a wire opening 118. The wire opening 118 is of a predetermined diameter and depth. Wire opening 118 penetrates the center bottom surface of pan head 112 and exits through to the top edge 116 of shaft 114. Refer to FIG. 10*a*.

FIG. 10*a* shows an enlarged isometric view of the neon lamp 120 and resistor 122. Base 94 has a neon lamp 120. The neon lamp 120 is of a predetermined size, shape, voltage, and wattage.

Figure 10B:
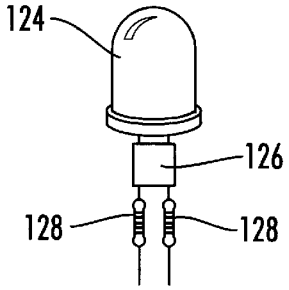
FIG. 10*b* shows an enlarged isometric view of the light emitting diode, bridge rectifier, and resistor.

Base 94 has a resistor 122. The resistor 122 is of a predetermined resistance and wattage. Refer to FIG. 10*b*.

Figure 10C:
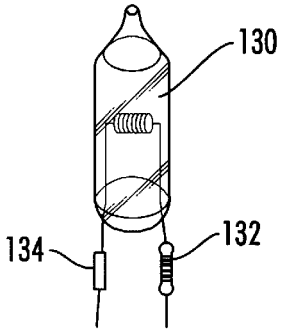
FIG. 10*c* shows an enlarged isometric view of the incandescent lamp, resistor, and a diode.

However, base 94 can contain a light emitting diode 124, a bridge rectifier 126, and resistor 128. Refer to FIG 10*c*.

Figure 11:
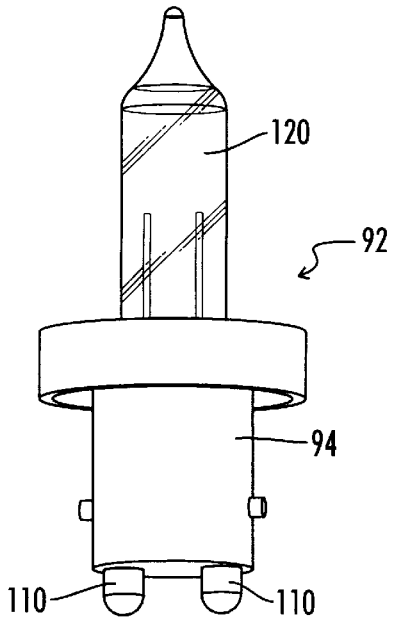
FIG. 11 shows an enlarged isometric view of the completed neon lamp assembly.
Figure 12:
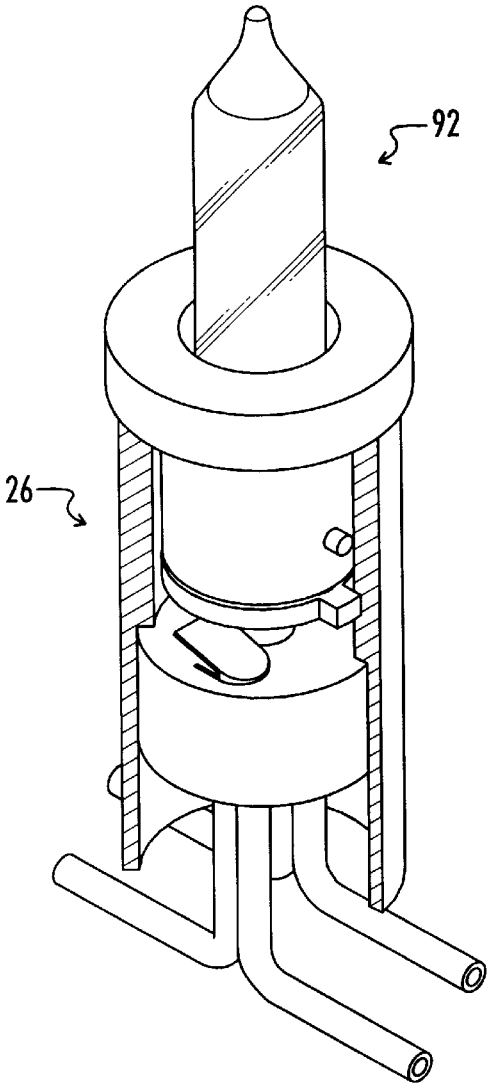
FIGS. 12 and 12*a,* respectively, show enlarged isometric views of the completed neon lamp assembly inserted into a completed lamp socket assembly, in its primary and secondary position.
Figure 12A:
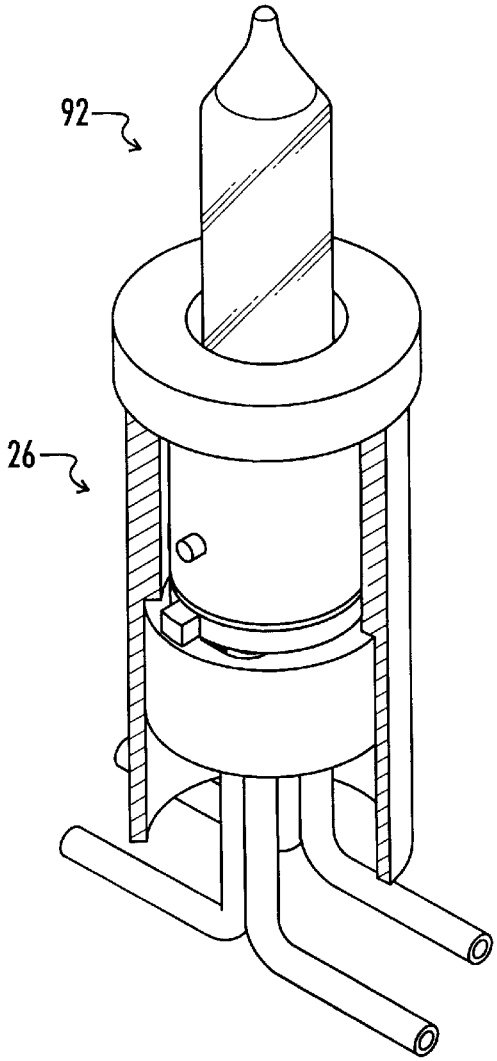
Figure 13:
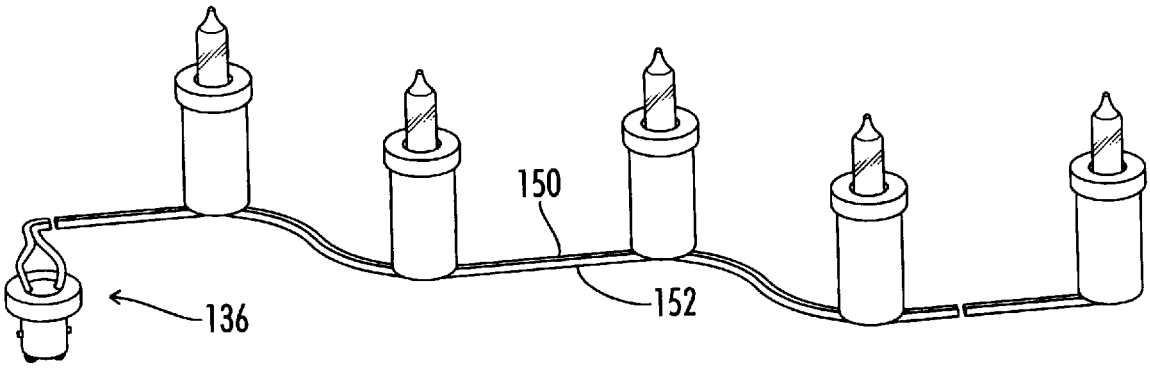
FIG. 13 shows an isometric view of the secondary light stringer.

Additionally, base 94 can contain an incandescent lamp 130, a resistor 132, or a diode 134, or both. Refer to FIG. 11. FIG. 11 shows an enlarged isometric view of the completed neon lamp assembly 92. Refer to FIGS. 12 and 12*a*. FIGS. 12 and 12*a*, respectively, show enlarged isometric views of the completed neon lamp assembly 92 inserted into a completed lamp socket assembly 26 in its primary and secondary position. Refer to FIG. 13.

The Description of the Secondary Light Stringer

Figure 14:
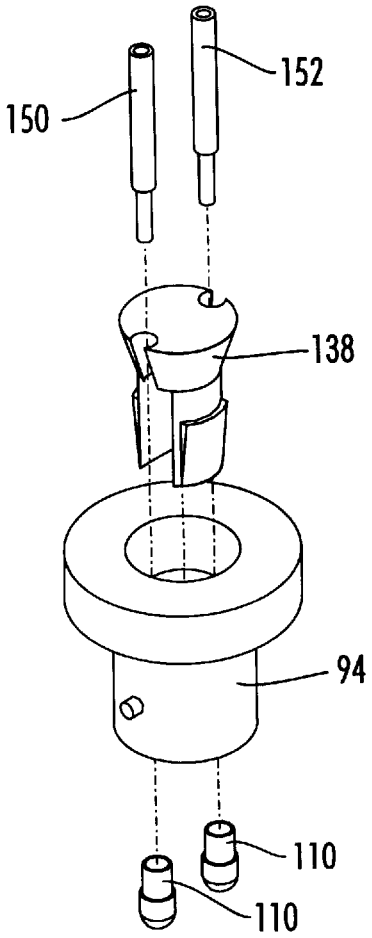
FIGS. 14 shows an enlarged isometric exploded view of the lamp socket compatible, male plug assembly.

FIG. 13 shows an isometric view of the secondary light stringer. The secondary light stringer has a lamp socket compatible, male plug assembly 136. Refer to FIG. 14.

Figure 15:
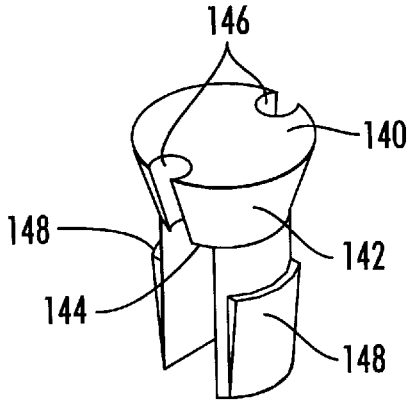
FIG. 15 shows an enlarged isometric view of the wire retainer.

FIG. 14 shows an enlarged isometric exploded view of the lamp socket compatible male plug assembly 136. The lamp socket compatible male plug assembly 136 utilizes an identical lamp base 94 of the neon lamp assembly 92. Lamp socket compatible, male plug assembly 136 has a wire retainer 138. The wire retainer 138 is preferably molded of the same fire-resistant synthetic resin as the above mentioned lamp socket 28. Refer to FIG. 15.

Figure 15A:
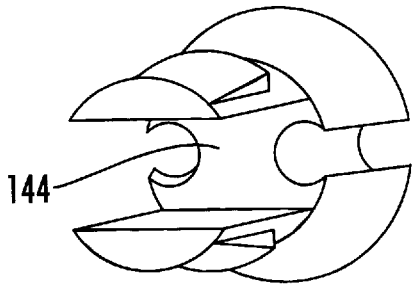
FIG. 15*a* shows an enlarged isometric bottom view of the wire retainer.

FIG. 15 shows an enlarged isometric view of wire retainer 138. Wire retainer 138 is of a one piece, self-locking design. Wire retainer 138 is molded generally, in a funnel shape. Wire retainer 138 has a flat top surface 140, a tapered exterior side surface 142, and a flat bottom surface 144. Located on the tapered exterior side surface 142 is a wire channel 146. The wire channel 146 is located, vertically into exterior side surface 142 to a predetermined shape, depth, and width. Wire channel 146 starts from the flat top surface 140, along exterior side surface 142, and exits at the flat bottom surface 144. Located 180-degrees around exterior side surface 142 and, equal distantly apart from wire channel 146, is an identical wire channel 146. Wire channels 146 are parallel in relation to each other. Refer to FIG. 15*a*.

Figure 16:
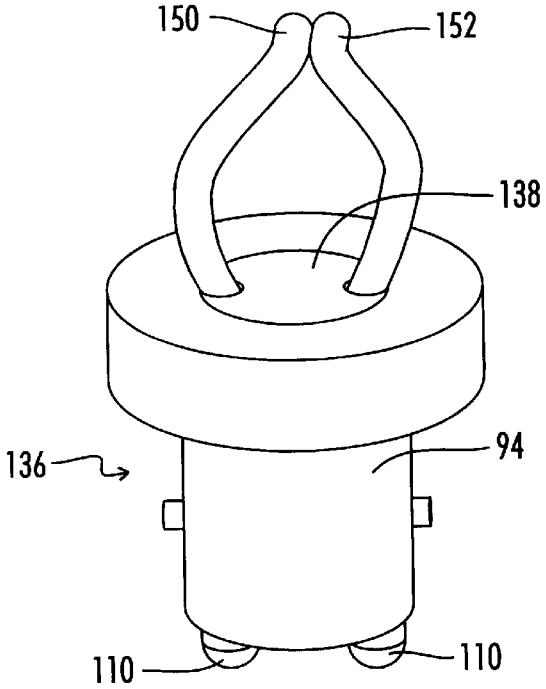
FIG. 16 shows an enlarged isometric view of the completed lamp socket compatible, male plug assembly.

FIG. 15*a* shows an enlarged isometric bottom view of the wire retainer 138. At a predetermined distance down from flat, bottom surface 144 is a right-angled, extending, locking finger 148. The extending, locking finger 148 is of a predetermined size, shape, length, width, and thickness. Locking finger 148 is perpendicular in relation to the flat bottom surface 144 and parallel to the exterior side surface 142. Locking finger 148 is an extension of the exterior side surface 142. Located 180-degrees from locking finger 148 is an identical locking finger 148. Locking fingers 148 are parallel in relation to each other. Locking fingers 148 are located 90-degrees in relation to the wire channels 146. Lamp socket compatible, male plug assembly 136 utilizes an identical electrical contact 110 of the neon lamp assembly 92. Refer to FIG. 16. FIG. 16 shows an enlarged isometric view of the completed lamp socket compatible male plug assembly 136. Refer back to FIG. 13.

Secondary light stringer has an insulated electrical wire 150 and an insulated electrical wire 152. The insulated electrical wire 150 is of a predetermined length. Wire 150 at predetermined locations along its length has predetermined amounts of insulation removed. Wire 150 is doubled precisely at the center point of insulation removal. This doubling of wire 150 continues along its length at the predetermined locations. The insulated electrical wire 152 is of a predetermined length. Wire 152 at predetermined locations along its length has predetermined amounts of insulation removed. Wire 152 is doubled precisely at the center point of insulation removal. This doubling of wire 152 continues along its length at the predetermined locations. Wire 150 and wire 152 are parallel in relation to each other. Wires 150 and 152 have a predetermined amount of insulation removed from each of their ends.

At this point, the remainder of the secondary light stringer is assembled identically as the primary light stringer.

The Operation of the Stringer of Decorative Lights

Figure 17:
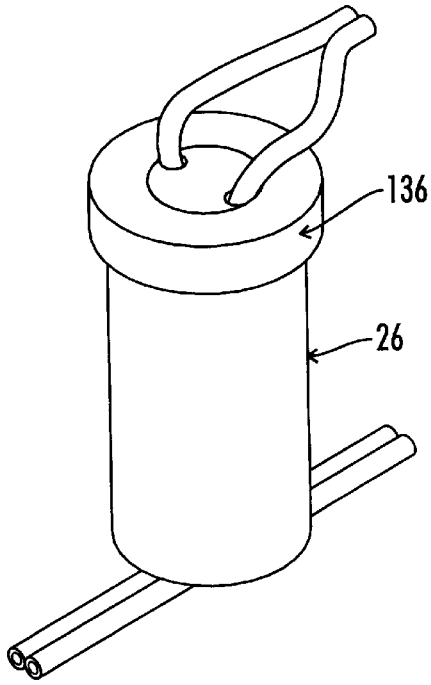
FIG. 17 shows an enlarged isometric view of the completed lamp socket compatible, male plug assembly inserted, into a completed lamp socket assembly.

The standard male plug 20 of the primary light stringer is inserted into a standard wall outlet (not shown). This powers and illuminates the neon lamp assemblies 92 of the primary light stringer. To connect a secondary light stringer to the primary light stringer requires the removal of any neon lamp assembly 92 from any lamp socket assembly 26 of the primary light stringer. The lamp socket compatible, male plug assembly 136 of the secondary light stringer can now be inserted into the empty lamp socket assembly 26 of the primary light stringer. This powers and illuminates the neon lamp assemblies 92 of the secondary light stringer. Refer to FIG. 17.

Figure 18:
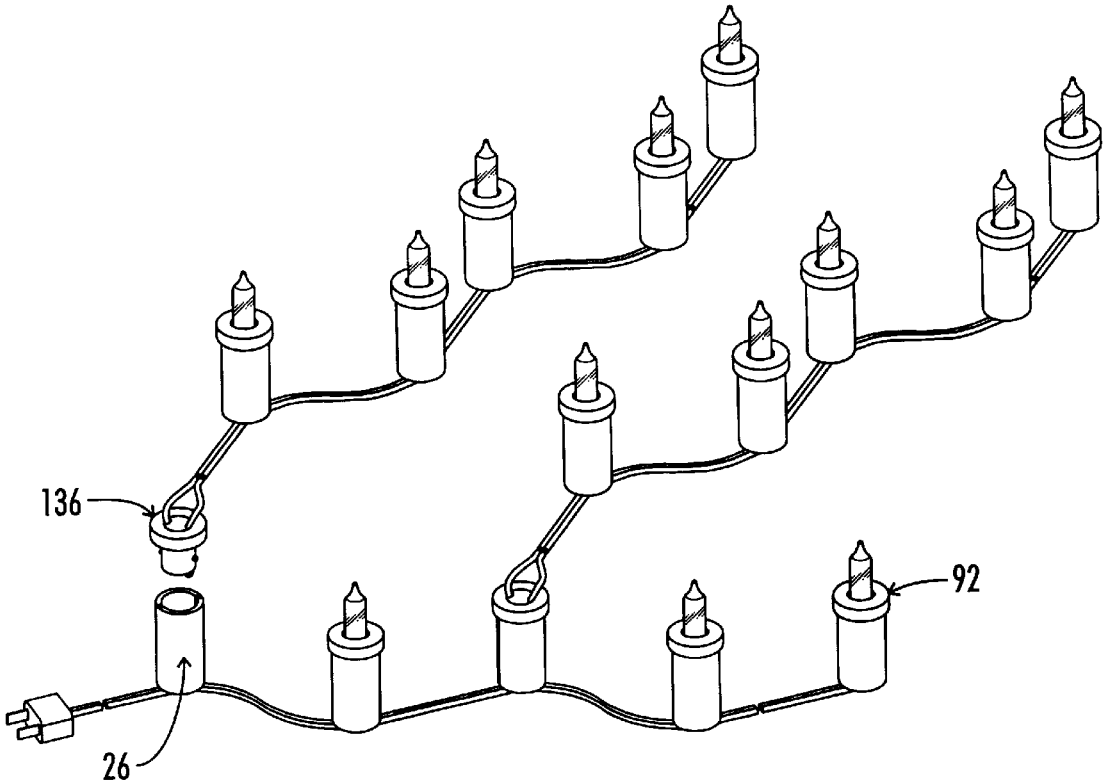
FIG. 18 shows an isometric view of the primary light stringer with, several interconnected secondary light stringers.

FIG. 17 shows an enlarged isometric view of the lamp socket compatible, male plug assembly 136 inserted, into a completed lamp socket assembly 26. Additional secondary light stringers are connected to the primary light stringer or any previously interconnected secondary light stringers in this same manner. Refer to FIG. 18.

FIG. 18 shows an isometric view of the primary light stringer with, several interconnected secondary light stringers.

Conclusions and Ramifications

Thus the reader will see that the stringer of decorative lights provides a safer, more energy efficient, easy to maintain light stringer which has the capability to utilize different sources of illumination and, offers a new flexibility in lighting design. By utilizing the parallel circuitry, for these light stringers, the removal or failure of a lamp will not effect the operation of the remaining lamps. This provides the user with a stringer of decorative lights that are easy to maintain. Additionally, this parallel circuitry provides improved short-circuit protection.

By utilizing neon lamps for these light stringers, they provide the user with a unique form of illumination. The neon lamps of these light stringers are inexpensive and rugged; they can withstand physical shock and vibration, as well as power surges. These neon lamps also run cool, and require very low current to operate. Standard brightness neon lamps have a design voltage of 65 Volts a/c. and a current draw of 0.0003 a. This produces a neon lamp with a wattage use of 0.0195 watts per lamp. The typical life rating of these neon lamps is 25,000 hours. However, by utilizing different value resistors, life ratings can exceed 50,000 hours. While these specific neon lamps are utilized with these light stringers, additional styles and types of neon lamps can be utilized.

Additionally, by using the proper voltage reduction means of electronic components within the standard lamp bases of these light stringers, a variety of lamp styles and types can be utilized. By installing a bridge rectifier and a resistor or resistors within these lamp bases, low voltage light-emitting diodes can be utilized in these light stringers. By installing a resistor or a diode, or both into these lamp bases, low voltage incandescent lamps can be utilized in these light stringers. While these low voltage lamp types and styles can be utilized, line voltage lamps can be utilized without the need for any electronic components installed within the lamp bases. This provides the user with a variety of lamp types and styles to choose from.

Each lamp socket assembly of these light stringers contains a rotary safety disc. While this rotary safety disc does not perform any working function of the circuitry in conjunction with this invention, it does help protect the user from accidental contact of energized electrical contacts within the lamp socket assemblies. The rotary safety disc covers these electrical contacts when a lamp assembly or lamp socket compatible, male plug is removed.

The lamp bases, lamp sockets, and lamp socket compatible male plug are, of the bayonet style. This provides the user with a quick and easy method of installing, retaining, or removing lamp assemblies and lamp socket compatible male plugs, from these light stringers.

The secondary light stringer utilizes a lamp socket compatible male plug. By inserting this male plug into any lamp socket of the primary light stringer, provides the user with a unique way of connecting and powering these secondary light stringers. Additional secondary light stringers can be connected to the primary light stringer or any previously interconnected secondary light stringer in this same manner. This provides the user with a new flexibility in decorative lighting design, which has not been available until now.

While our above description contains many specific embodiments, these should not be construed as limitations on the scope of the invention, but rather as an exemplification of one preferred embodiment thereof. Many other variations are possible. For example, a two-wire jumper cable having only a lamp socket on one end, and a lamp socket compatible male plug on the other end, could provide the user with additional flexibility in lighting design. The jumper cables would allow the stringers of lights to be interconnected in such a way as to decorate several different objects without any unwanted lights between them. A third wire can be included throughout the primary and secondary light stringers as well as the lamp sockets providing a grounding wire for the stringer of decorative lights.

The stringer of decorative lights can be made to flicker, pulsate, chase etc., by incorporating multiple parallel circuits, electronic flasher and timer circuitry, or the like, to increase the "visual appeal" of these light stringers. The lamp socket assemblies can incorporate a decorative light diffuser that surrounds the lamps. Electrically powered decorative objects such as illuminated or motorized or a combination thereof, ornaments, candle operas, Christmas figurines, wreaths, and the like, will provide the user with an almost limitless variety of decorating options for inside and outside use.

The lamp socket compatible male plug of the secondary light stringer can be designed as a combination lamp socket, male plug. This can provide the user with an additional flexible lighting design option. A standard male plug containing a lamp socket assembly(s) can be designed to eliminate the need for the primary light stringer while adding an additional lighting design option. A standard female receptacle containing a lamp base or bases can be designed to allow the interconnection of existing light stringers or decorations or both to the primary or secondary light stringers, or both, while adding an additional lighting design option to this invention.

Molding the neon lamps and resistors to the electrical conductors such as a one piece plastic injected mold or the like, can eliminate the need for the safety disc, all electrical contacts, and the separate lamp base and socket assemblies. Additionally, increasing the resistance of the circuitry would eliminate the need for the individual neon lamp shaving external resistors. The lamp socket compatible male plug can be molded in one piece. This would eliminate the wire retainer. The neon lamp can integrally contain the resistor into the glass base of the neon lamp and thereby eliminate the external resistor. The light-emitting diode can integrally contain the bridge rectifier and a resistor or resistors, which can be formed into a single unit. The incandescent lamp can integrally contain a resistor or a diode or both, which can also be formed into a single unit.

The improved version of the bayonet style of lamp socket and rotary safety disc can be utilized to replace the standard screw shell sockets of table lamps, overhead light fixtures, etc. The rotary safety disc can be integrated into the face of electrical receptacles eliminating the need for safety inserts or "safety receptacles" which are needed around small children, and the like.

The stringer of decorative lights can utilize many different types of plastics, metals, or the like in the manufacture of the lamp bases, lamp sockets, and the like. The electrical conductors can be of many different sizes as well as having a variety of insulation types. The electrical contacts can be made out of a variety of electrically conductive materials as well as various shapes and sizes.

The stringer of decorative lights can be manufactured in a variety of different shapes, sizes, and colors including the lamp bases, lamp sockets, rotary disc, contacts, conductors, conductor insulation, lamps, resistors, and the like. The contact types can be of the crimp style, solder style, forced-to-fit style, and the like. A variety of lamp socket styles can be utilized including, screw shell, push-to-fit, bayonet double contact, bayonet single contact, and the like.

Thus, although there have been described particular embodiments of the present invention of a new and useful Stringer of Decorative Lights, it is not intended that such references be construed as limitations upon the scope of this invention except as set forth in the following claims.

What is claimed is:

1. A stringer of lights comprising:

a first power cord including a plug;

a plurality of lamp socket assemblies electrically connected in parallel to the first power cord;

a plurality of lamp assemblies removably inserted into, and electrically connected to the lamp sockets, respectively, each lamp assembly including a voltage reduction circuit;

an insulated lamp base adapted to be received in one of the lamp socket assemblies;

a lamp inserted into the lamp base; and a plurality of lamp electrical contacts extending below the lamp base and electrically connected to the lamp;

a lamp socket having a top for receiving one of the lamp bases, and a bottom connected to the first power cord;

a plurality of lamp socket electrical contacts proximate the bottom and electrically connected to the power cord; and a safety disc in the lamp socket interposed between the top of the lamp socket and the lamp socket electrical contacts, the safety disc including safety means for preventing inadvertent contact with the lamp socket electrical contacts.

2. The stringer of claim 1, wherein the safety means comprises a pair of contact openings through which the lamp electrical contacts pass only when the contact openings are aligned with the lamp socket electrical contacts, the contact openings being aligned when the lamp is mounted in the lamp socket.

3. A stringer of lights comprising:

a first power cord including a plug;

a plurality of lamp socket assemblies electrically connected in parallel to the first power cord;

a plurality of lamp assemblies removably inserted into, and electrically connected to the lamp sockets, respectively, each lamp assembly including a voltage reduction circuit;

the lamp assemblies having a bayonet style, and the lamp base including diametrically opposed alignment pins;

the lamp socket including a bottom near the cord, a top space away from the cord, an interior surface having diametrically opposed vertical grooves for receiving the alignment pins, a lower pair of horizontal grooves in the interior surface proximate the lamp socket bottom, an upper pair of horizontal grooves in the interior surface proximate the top of the lamp socket, each upper horizontal groove opening on one of the vertical alignment grooves, wherein the lower pair of horizontal grooves is parallel to the upper pair of horizontal grooves; and a safety disc rotatably mounted in the lower pair of horizontal grooves, and wherein aligning the lamp base aligns the safety disc such that the lamp base is electrically connected to the lamp socket.

4. The stringer of claim 3, further comprising:

a second power cord having a plug, the plug adapted to be removably inserted into one of the lamp sockets connected to the first power cord;

a plurality of lamp socket assemblies electrically connected in parallel to the second power cord; and a plurality of lamp assemblies removably inserted into, and electrically connected to, respective lamp sockets, each lamp assembly including a voltage reduction circuit.

5. A stringer of lights comprising:

a first power cord including a plug;

a plurality of lamp socket assemblies electrically connected in parallel to the first power cord;

a plurality of lamp assemblies removably inserted into, and electrically connected to the lamp sockets, respectively, each lamp assembly including a voltage reduction circuit;

a lamp socket having a top, and a bottom connected to the first power cord;

a plurality of lamp socket electrical contacts proximate the bottom and electrically connected to the power cord; and a safety disc in the lamp socket interposed between the top of the lamp socket and the lamp socket electrical contacts, the safety disc including safety means for preventing inadvertent contact with the lamp socket electrical contacts.

6. A string of decorative lights comprising:

a power cord including a plug;

a plurality of lamp socket assemblies electrically connected to the power cord, each lamp socket assembly including a lamp socket having an interior surface, a top, a vertical alignment groove in the interior surface depending from the top, and a horizontal groove in the interior surface opening on the vertical alignment groove; and a plurality of lamp assemblies each having a lamp base including an alignment pin, the lamp base removably inserted into one of the lamp sockets, the alignment pin engaging the horizontal groove to secure the lamp base in the lamp socket; and a plurality of safety discs, each safety disc disposed in the lamp socket below the lamp base, wherein each safety disc is rotatably connected to the lamp socket and includes means for allowing the lamp base to electrically connect to the lamp socket when the lamp base is aligned in the lamp socket.

7. A lamp socket having a top, a bottom, and a lamp socket electrical contact proximate the bottom, the lamp socket adapted to receive a lamp assembly having lamp electrical contacts, the improvement comprising a safety disc within the lamp socket positioned between the top of the lamp socket and the lamp socket electrical contacts, the safety disc including safety means to prevent inadvertent contact with the lamp socket electrical contacts; and wherein the safety means comprises a contact opening through which the lamp electrical contacts electrically connect to the lamp socket electrical contacts when the contact opening is aligned with the lamp socket electrical contacts; and rotatable means for aligning the contact opening with the lamp socket electrical contacts when the lamp assembly is mounted in the lamp socket.

* * * * *